US009639039B2

(12) United States Patent
Shiki et al.

(10) Patent No.: US 9,639,039 B2
(45) Date of Patent: May 2, 2017

(54) IMAGE FORMING APPARATUS

(71) Applicant: KONICA MINOLTA, INC., Chiyoda-ku, Tokyo OT (JP)

(72) Inventors: Takanobu Shiki, Sagamihara (JP); Tadayuki Ueda, Kokubunji (JP); Eiji Nishikawa, Tama (JP); Yukinobu Iguchi, Hamamatsu (JP); Satoshi Miyajima, Hino (JP); Yohei Yamada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/145,978

(22) Filed: May 4, 2016

(65) Prior Publication Data

US 2016/0327890 A1 Nov. 10, 2016

(30) Foreign Application Priority Data

May 8, 2015 (JP) ..... 2015-095879

(51) Int. Cl.
*G03G 15/20* (2006.01)
*G03G 15/00* (2006.01)

(52) U.S. Cl.
CPC ..... *G03G 15/2039* (2013.01); *G03G 15/6594* (2013.01); *G03G 2215/00738* (2013.01)

(58) Field of Classification Search
CPC ..... G03G 15/2039; G03G 15/6594
USPC ..... 399/69
See application file for complete search history.

(56) References Cited

U.S. PATENT DOCUMENTS

2015/0071660 A1* 3/2015 Yamashina ..... G03G 15/55 399/45

FOREIGN PATENT DOCUMENTS

JP 2008-180947 A 8/2008

* cited by examiner

*Primary Examiner* — Hoang Ngo
(74) *Attorney, Agent, or Firm* — Buchanan Ingersoll & Rooney PC

(57) ABSTRACT

An image forming apparatus detects that the temperature of a fixing member reaches a lower limit value at which the temperature once reduced by the start of a heating and fixing process to a paper turns to rise, after an image forming operation starts, and determines the type of the paper based on at least one of an elapsed time from a predetermined reference time point after the image forming operation starts to a time point at which it is detected that the temperature reaches the lower limit value, and a temperature difference between the temperature of the fixing member at the reference time point and the lower limit value.

4 Claims, 7 Drawing Sheets

Contacting position

Separating position

FIG.6A

210

| | | Arrival time Tx | | |
|---|---|---|---|---|
| | | Smaller than 3 sec | Equal to more than 3 sec and smaller than 5 sec | Equal to more than 5 sec |
| Temperature difference Td | Smaller than 5°C | 160 | 165 | 170 |
| | Equal to more than 5°C and smaller than 10°C | 165 | 170 | 175 |
| | Equal to more than 10°C | 170 | 175 | 180 |

FIG.6B

220

| | | Arrival time Tx | | |
|---|---|---|---|---|
| | | Smaller than 3 sec | Equal to more than 3 sec and smaller than 5 sec | Equal to more than 5 sec |
| Temperature difference Td | Smaller than 5°C | 3 | 4 | 6 |
| | Equal to more than 5°C and smaller than 10°C | 4 | 5 | 8 |
| | Equal to more than 10°C | 6 | 8 | 10 |

IMAGE FORMING APPARATUS

CROSS-REFERENCE TO RELATED APPLICATION

This application is based on Japanese Patent Application No. 2015-095879 filed on May 8, 2015, the contents of which are incorporated herein by reference.

BACKGROUND

1. Technical Field

The present invention relates to an image forming apparatus.

2. Description of Related Art

In an electrophotographic image forming apparatus, control parameters of a fixing unit for heating and fixing a toner image onto a paper (a sheet of paper) are changed according to the type of a paper on which an image is formed. For example, when a paper is a thick paper, the temperature of a heating roller is set to be high as compared with the case in which a paper is a plain paper.

In relation to this, Japanese Unexamined Patent Publication No. 2008-180947 discloses a technology of measuring the temperature of a heating roller before and after one paper passes through a fixing unit and determining the type of the paper from a temperature gradient. According to this technology, it is possible to automatically determine the type of a paper and determine control parameters of the fixing unit.

However, in this technology, since a small temperature change when one paper passes through the fixing unit is measured, there is a possibility that the type of the paper cannot be determined correctly. On the other hand, a temperature change when a plurality of papers pass through the fixing unit is also considered to be measured, but if a time for determining the type of the paper is too long, since a time until the state of the fixing unit is stabilized also becomes long, it is not preferable.

SUMMARY

The present invention has been accomplished in view of the above problem. Accordingly, objectives of the present invention are to provide an image forming apparatus capable of accurately determining the type of the paper in a short time as much as possible by measuring the temperature of a fixing member.

In order to achieve at least one of the abovementioned objects, an image forming apparatus, reflecting one aspect of the present invention, includes: a paper feeding tray configured to store papers; a conveying unit configured to convey a paper stored in the paper feeding tray; an image forming unit configured to form a toner image on the paper conveyed by the conveying unit; a fixing member configured to heat and fix the toner image formed by the image forming unit onto the paper; a temperature sensor configured to detect a temperature of the fixing member; a heater configured to heat the fixing member; a detection unit configured to detect that the temperature of the fixing member reaches a lower limit value at which the temperature once reduced by start of a heating and fixing process to the paper turns to rise, after an image forming operation starts; and a determination unit configured to determine a type of the paper based on at least one of an elapsed time from a predetermined reference time point after the image forming operation starts to a time point at which it is detected that the temperature of the fixing member reaches the lower limit value, and a temperature difference between the temperature of the fixing member at the reference time point and the lower limit value.

Preferably, in the image forming apparatus, the determination unit determines that the paper is thicker as the temperature difference is larger.

Preferably, in the image forming apparatus, the determination unit determines that the paper is thicker as the elapsed time is longer.

Preferably, the image forming apparatus further includes a controller configured to control an operation of the heater by reflecting the type of the paper determined by the determination unit in a control parameter of the heater.

The objects, features, and characteristics of this invention other than those set forth above will become apparent from the description given herein below with reference to preferred embodiments illustrated in the accompanying drawings.

BRIEF DESCRIPTION OF THE DRAWINGS

FIGS. 6A and 6B are diagrams showing an example of conversion tables for determining control parameters.

DETAILED DESCRIPTION

Figure 1:
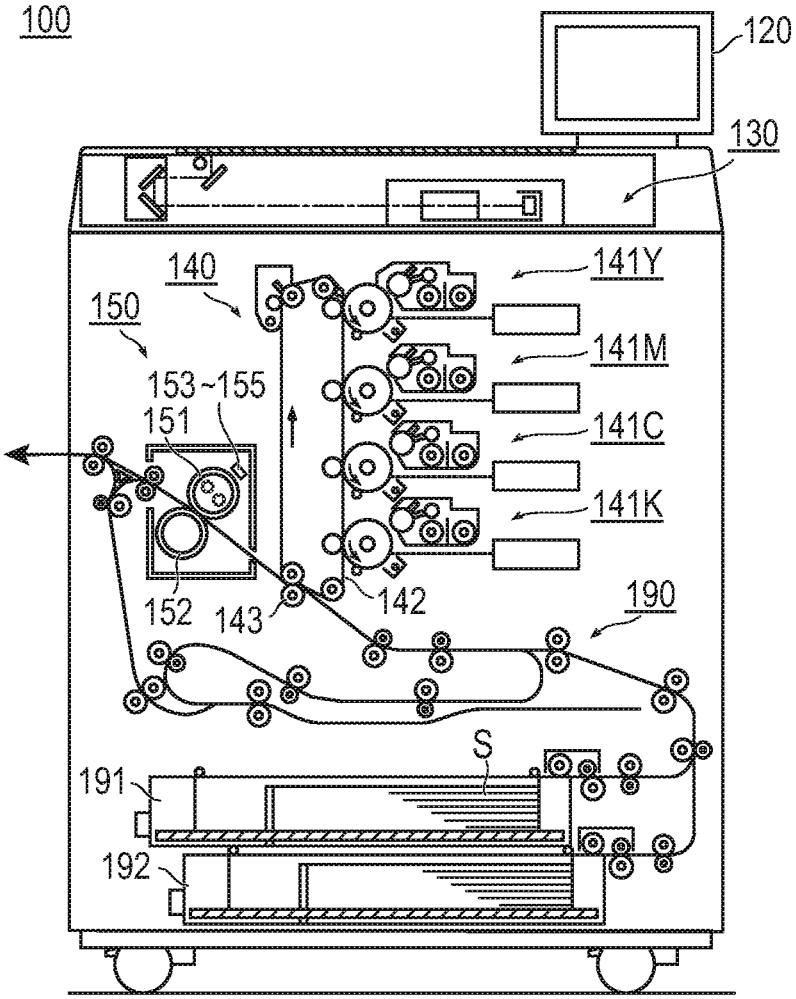
FIG. 1 is a diagram showing a schematic configuration of an image forming apparatus according to an embodiment of the present invention.

The embodiments of this invention will be described in detail with reference to the accompanying drawings. In addition, in the description of the drawings, the same elements are denoted by the same reference numerals, and redundant description is omitted. Furthermore, dimensional ratios in the drawings are exaggerated and different from actual ratios for convenience of the description.

Figure 2:
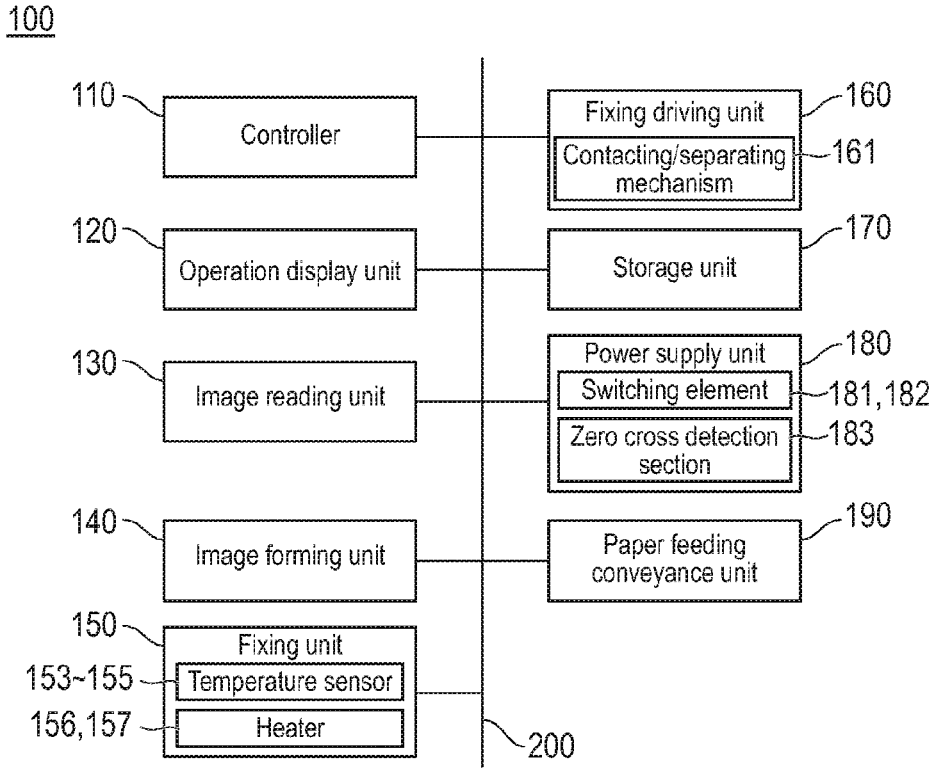
FIG. 2 is a block diagram showing a hardware configuration of an image forming apparatus.
Figure 3A:
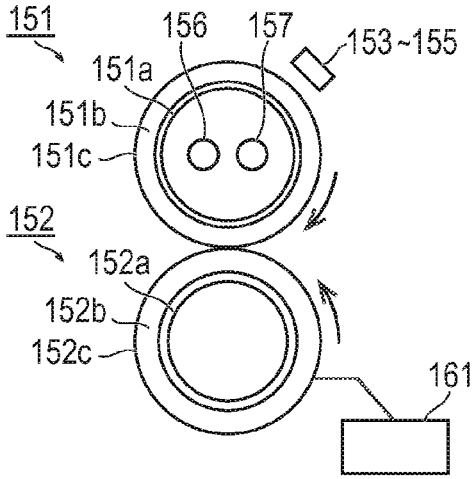
FIGS. 3A and 3B are diagrams each showing a schematic configuration of a fixing unit.
Figure 3B:
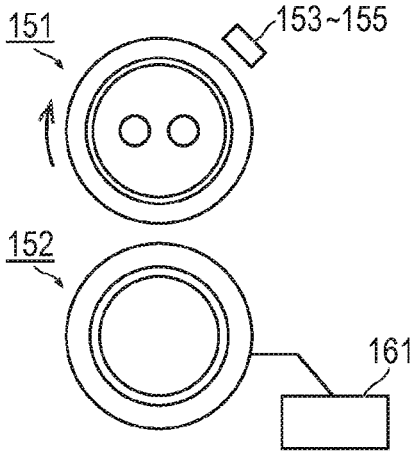
Figure 4:
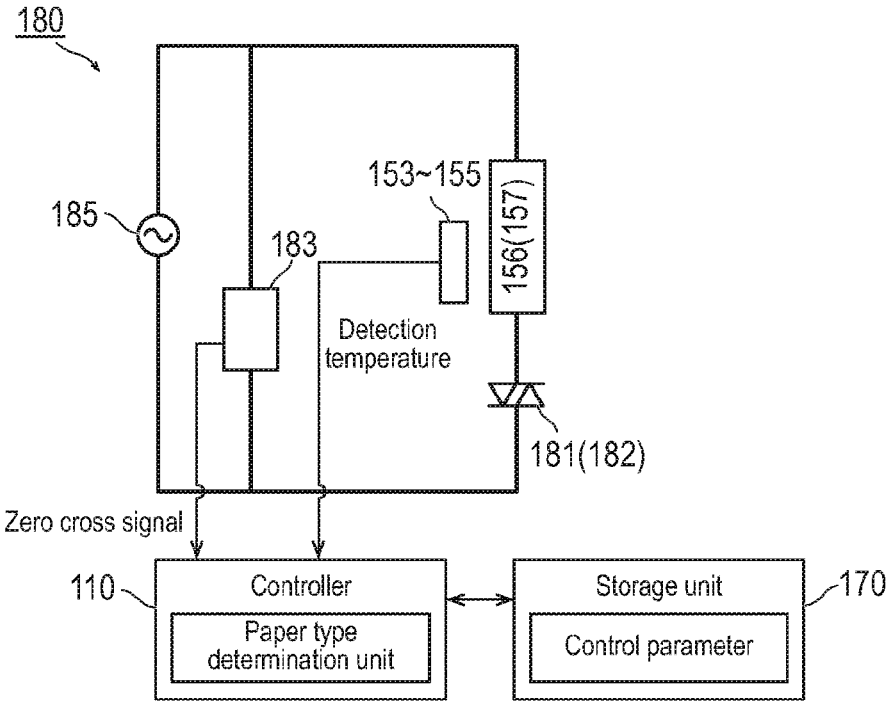
FIG. 4 is a schematic diagram showing a configuration of a power supply unit.

FIG. 1 is a diagram showing a schematic configuration of an image forming apparatus 100 according to an embodiment of the present invention, and FIG. 2 is a block diagram showing a hardware configuration of the image forming apparatus 100. FIGS. 3A and 3B are diagrams each showing a schematic configuration of a fixing unit 150, and FIG. 4 is a schematic diagram showing a configuration of a power supply unit 180.

As shown in FIG. 1 and FIG. 2, the image forming apparatus 100 includes a controller 110, an operating display unit 120, an image reading unit 130, an image forming unit 140, a fixing unit 150, a fixing driving unit 160, a storage unit 170, a power supply unit 180, a paper feeding conveyance unit 190, and signal lines 200 for electrically connecting these units to one another.

The controller 110 includes CPU (Central Processing Unit), RAM (Random Access Memory), and ROM (Read Only Memory), appropriately reads out various programs stored in the ROM, the storage unit 170 and the like, and develops the read programs on the RAM, wherein the CPU executes the developed programs, thereby performing various functions.

The operating display unit 120, for example, is formed by superposing a touch sensor on a display surface of LCD (Liquid Crystal Display), and displays an operation screen and receives various operations by a user.

The image reading unit 130 includes an optical system configured from a mirror and a lens and an imaging device such as a CCD (Charge Coupled Device) image sensor, and reads a document placed on a platen glass or a document conveyed from ADF (Auto Document Feeder) (not shown), thereby generating image data.

The image forming unit 140 includes developing units 141Y, 141M, 141C, and 141K corresponding to toner of Y, M, C, and K colors. Toner images formed through charging, exposure, and development processes by the developing units 141Y, 141M, 141C, and 141K are sequentially superposed on an intermediate transfer belt 142 and are transferred onto a paper S by a secondary transfer roller 143.

The fixing unit 150 includes a heating roller 151 acting as a fixing member and a pressure roller 152, heats and presses the paper S conveyed to a fixing nip between both these rollers 151 and 152, and melts and fixes the toner images on the paper S to the surface of the paper S. In the vicinity of the heating roller 151, temperature sensors 153 to 155 are provided.

As shown in FIG. 3A, the heating roller 151 includes, in the order from the inner side, a core metal 151*a* composed of a cylindrical metal, an elastic layer 151*b* which is formed on the core metal 151*a* and composed of a material such as silicone rubber and foamed silicone rubber, and a releasing layer 151*c* such as fluororesin. In the core metal 151*a*, two halogen lamp heaters 156 and 157 are disposed. The length of the heating roller 151 in a rotation shaft direction (hereinafter, simply referred to as a "width direction") perpendicular to a conveyance direction of the paper S is enough for fixing the paper S with a maximum conveyable paper width. The two heaters 156 and 157 may also be configured from heaters with different heat distributions (light distribution characteristics) corresponding to a plurality of stages of paper widths which can be fed in the image forming apparatus 100. For example, the heater 156 is a center heater having a heat generation amount distribution in which a heat generation amount of a center portion is larger than heat generation amounts of both end portions, and the heater 157 can employ an end heater having a heat generation amount distribution in which heat generation amounts of both end portions are larger than a heat generation amount of a center portion. In addition, the number of heaters is not limited to two, and one heater may also be used, or three or more heaters may also be used.

The pressure roller 152 includes, in the order from the inner side, a core metal 152*a* composed of a cylindrical metal, an elastic layer 152*b* which is formed on the core metal 152*a* and composed of a material such as silicone rubber and foamed silicone rubber, and a releasing layer 152*c* such as fluororesin. The outer diameter and axial length of the pressure roller 152 are equal to those of the heating roller 151. In addition, a heater may also be disposed inside of the core metal 152*a* of the pressure roller 152.

The temperature sensors 153 to 155 detect the surface temperature of the heating roller 151. The temperature sensors 153 to 155 are respectively disposed at a center part, a back side, and a front side which are different positions in a width direction, and measure an axial temperature distribution of the heating roller 151. As the temperature sensors 153 to 155, for example, thermistors disposed in a non-contact state for the heating roller 151 are used.

The fixing driving unit 160 includes a driving motor, thereby rotationally driving the heating roller 151 or both of the heating roller 151 and the pressure roller 152. Furthermore, the fixing driving unit 160 includes a contacting/separating mechanism 161 configured from a cam mechanism and a driving source, thereby moving the pressure roller 152 between a "contacting position" and a "separating position". As shown in FIG. 3A, in the "contacting position", the pressure roller 152 is energized toward the heating roller 151 at predetermined pressure, so that a fixing nip is formed between both rollers 151 and 152. As shown in FIG. 3B, in the "separating position", the pressure roller 152 moves downward. In the "separating position", the pressure roller 152 and the heating roller 151 do not contact with each other. In a standby state of the image forming apparatus 100, the pressure roller 152 is stationary, but the heating roller 151 rotates at a speed lower than a normal rotation speed (at the time of image formation). Furthermore, in the standby state, the temperature of the heating roller 151 is maintained to a temperature lower than that at the time of image formation.

The storage unit 170 is an auxiliary storage device configured with HDD (Hard Disk Drive) or a semiconductor memory such as SSD (Solid State Drive). The storage unit 170 stores a plurality of types of control parameters for calculating a duty ratio from the detection temperatures of the temperature sensors 153 to 155.

The power supply unit 180 includes a plurality of switching elements 181 and 182 and a zero cross detection section 183. As shown in FIG. 4, the power supply unit 180, for example, is connected to a commercial alternating current power supply 185 of a voltage 100 V and a frequency 50/60 Hz and supplies power to the heaters 156 and 157 and each unit of the image forming apparatus 100. The zero cross detection section 183 outputs a zero cross signal at a timing when the voltage output of the commercial alternating current power supply 185 crosses a voltage level of 0 V. In addition, as shown in FIG. 4 in an omitting manner, the heaters 156 and 157 are connected in parallel to the alternating current power supply 185, and the switching elements 181 and 182 are respectively provided to power lines of the heaters 156 and 157 in correspondence to the heaters 156 and 157.

The controller 110 performs duty control, in which a predetermined period corresponding to an integral multiple of a half wave of the commercial alternating current power supply 185 is employed as a control cycle, by using the zero cross signal. This control cycle, for example, is fifteen half-wave lengths. The control cycle of the fifteen half-wave lengths corresponds to 300 msec in the case of a commercial power supply of 50 Hz. The controller 110 controls the switching elements 181 and 182 in synchronization with the zero cross signal and performs on/off control of the heaters 156 and 157 in a half-wave unit. In the fifteen half-waves of the control cycle, for example, if the heaters 156 and 157 are turned on during the period of 1 half-wave, the duty ratio becomes 6.7%, and if the heaters 156 and 157 are turned on during the periods (all the periods) of the fifteen half-waves, the duty ratio becomes 100%.

The paper feeding conveyance unit 190 includes a plurality of paper feeding trays 191 and 192 and a plurality of pairs of conveying rollers driven by a conveying motor (not shown). The paper feeding trays 191 and 192 store a number of papers S therein. The papers S stored in the paper feeding trays 191 and 192 are fed to a downstream conveyance path one by one.

In addition, the image forming apparatus 100 may also include elements other than the above-described elements, or may not include a part of the above-described elements.

In the image forming apparatus 100 configured as described above, a temperature transition of the heating roller 151 is measured after the start of an image forming operation, so that the type of the paper S is determined. Hereinafter, with reference to FIG. 5 to FIG. 8B, an operation of the image forming apparatus 100 will be described.

Figure 5:
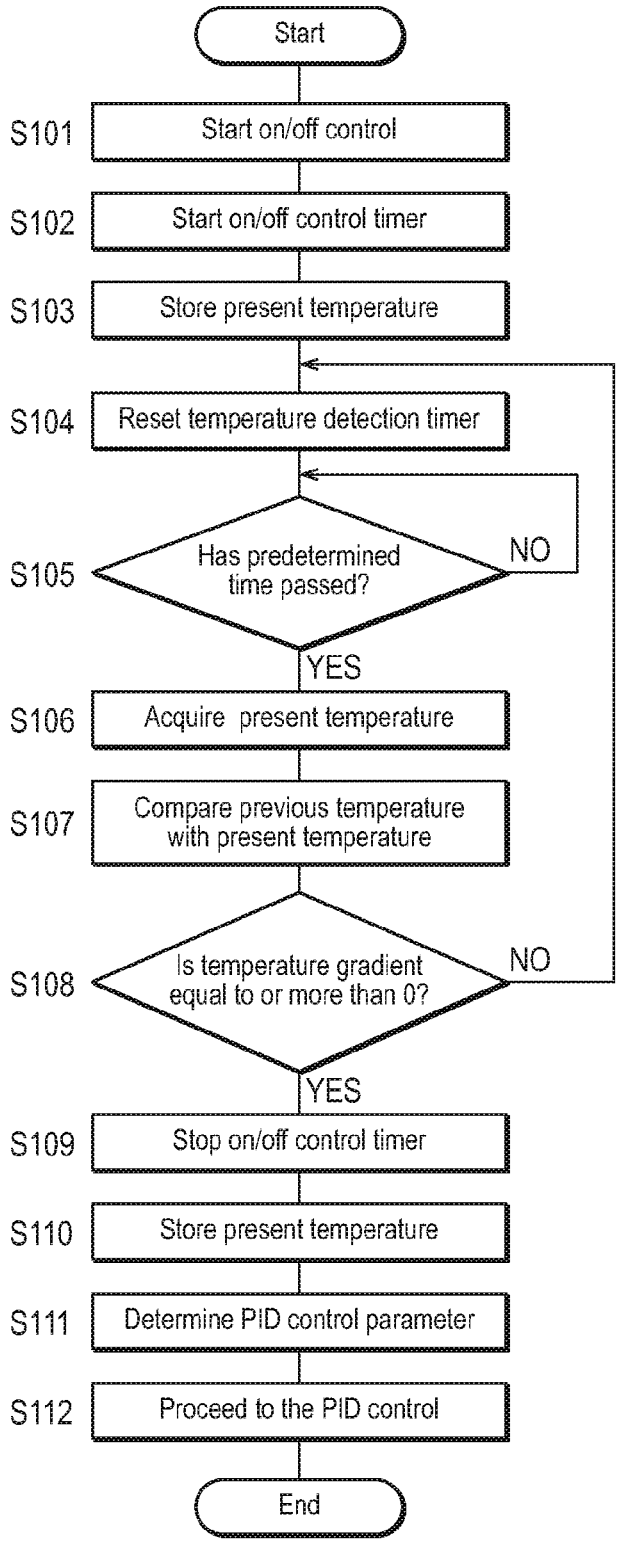
FIG. 5 is a flowchart showing a procedure of a paper type determination process.

FIG. 5 is a flowchart showing a procedure of a paper type determination process performed by the image forming apparatus 100. In addition, an algorithm shown in the flowchart of FIG. 5 is stored in the storage unit 170 as a program and is executed by the CPU. Furthermore, hereinafter, a case in which a copy process is performed by the image forming apparatus 100 will be described as an example.

When a copy start instruction is received from a user, the image forming apparatus 100 starts on/off control (step S101). In more detail, firstly, the pressure roller 152 moves to the "contacting position" and rotates together with the heating roller 151. Then, the controller 110 of the image forming apparatus 100 starts on/off control for turning off the heaters 156 and 157 in the heating roller 151 when the temperature of the heating roller 151 is higher than a target temperature, and turning on the heaters 156 and 157 at fixed duty ratios (for example, 100% for both) when the temperature of the heating roller 151 is lower than the target temperature.

Next, the image forming apparatus 100 starts an on/off control timer (step S102). In more detail, the controller 110 of the image forming apparatus 100 starts a timer for measuring an elapsed time from a start time point of the on/off control.

Next, the image forming apparatus 100 stores a present temperature (step S103). In more detail, the controller 110 of the image forming apparatus 100, for example, stores the present temperature of the heating roller 151, which is detected by the temperature sensor 153 of the center part, in the RAM as the temperature of the heating roller 151 at the start time point of the on/off control.

As described above, according to the processes shown in steps S101 to S103 of FIG. 5, by the start of the image forming operation, the on/off control of the heaters 156 and 157 is started and the measurement of the elapsed time from the start time point of the on/off control is started. Furthermore, the temperature of the heating roller 151 at the start time point of the on/off control is stored. After the on/off control starts, a paper S with a toner image formed by the image forming unit 140 is conveyed to the fixing unit 150, and the fixing unit 150 performs a heating and fixing process on the paper S conveyed from the image forming unit 140. Immediately after the heating and fixing process starts, the heating roller 151 is heated by the heaters 156 and 157, but heat applied by the heaters 156 and 157 is not immediately transmitted to the surface of the heating roller 151. On the other hand, heat of the surface of the heating roller 151 is taken away by the papers S continuously conveyed to the fixing unit 150 from the image forming unit 140. Consequently, immediately after the heating and fixing process starts, the surface temperature of the heating roller 151 is reduced once.

Next, the image forming apparatus 100 resets a temperature detection timer (step S104). In more detail, the controller 110 of the image forming apparatus 100 resets a timer for measuring the temperature of the heating roller 151 at a predetermined cycle (for example, 600 msec).

Next, the image forming apparatus 100 determines whether a predetermined time has passed (step S105). In more detail, the controller 110 of the image forming apparatus 100 determines whether a predetermined time (for example, 600 msec) has passed after the timer is reset in the process shown in step S104.

When it is determined that the predetermined time has not passed (step S105: NO), the image forming apparatus 100 waits until the predetermined time passes. On the other hand, when it is determined that the predetermined time has passed (step S105: YES), the image forming apparatus 100 acquires a present temperature (step S106). In more detail, the controller 110 of the image forming apparatus 100 acquires the present temperature of the heating roller 151, which is detected by the temperature sensor 153 of the center part.

Next, the image forming apparatus 100 compares a previous temperature with the present temperature (step S107). In more detail, the controller 110 of the image forming apparatus 100 subtracts a temperature acquired immediately before (for example, before 600 msec) from the temperature acquired in the process shown in step S106, thereby calculating a temperature difference between the previous temperature and the present temperature.

Then, the image forming apparatus 100 determines whether a temperature gradient is equal to or more than 0 (step S108). In more detail, the controller 110 of the image forming apparatus 100 determines whether the temperature difference calculated in the process shown in step S107 is equal to or more than 0. In other words, the controller 110 determines whether the surface temperature of the heating roller 151, which has been reduced once by the start of the heating and fixing process, has turned to rise.

When it is determined that the temperature gradient is smaller than 0 (step S108: NO), the image forming apparatus 100 returns to the process of step S104. Then, the image forming apparatus 100 repeats the processes after step S104 until the temperature gradient is equal to or more than 0.

On the other hand, when it is determined that the temperature gradient is equal to or more than 0 (step S108: YES), the image forming apparatus 100 stops the on/off control timer (step S109). In more detail, since the temperature of the heating roller 151 has turned to rise, the controller 110 of the image forming apparatus 100 stops the on/off control timer started in the process shown in step S102.

Next, the image forming apparatus 100 stores the present temperature (step S110). In more detail, the controller 110 of the image forming apparatus 100 stores the temperature acquired in the process shown in step S106 in the RAM as a lower limit value of the temperature of the heating roller 151.

As described above, according to the processes shown in steps S104 to S110 of FIG. 5, the temperature transition of the heating roller 151 is measured and it is detected that the temperature of the heating roller 151 has reached the lower limit value at which the temperature once reduced by the start of the heating and fixing process to the paper S turns to rise. Then, the measurement of the elapsed time from the start time point of the on/off control is stopped and the temperature of the heating roller 151 is stored.

Next, the image forming apparatus 100 determines PID control parameters (step S111). In more detail, the controller 110 of the image forming apparatus 100 firstly acquires the elapsed time measured by the on/off control timer as an arrival time Tx until the temperature of the heating roller 151 reaches the aforementioned lower limit value from the start time point of the on/off control. Furthermore, the controller 110 calculates a temperature difference between the temperature stored in the process shown in step S103 and the temperature stored in the process shown in step S110 as a temperature difference Td between the temperature of the heating roller 151 at the start time point of the on/off control and the aforementioned lower limit value. Then, with reference to predetermined conversion tables 210 and 220 (see FIGS. 6A and 6B), the controller 110 determines a target temperature, a P constant, an I constant, and a D constant from the arrival time Tx and the temperature difference Td as the PID control parameters of the heaters 156 and 157.

FIGS. 6A and 6B are diagrams showing an example of the conversion tables 210 and 220 for determining the control parameters. FIG. 6A is a diagram showing an example of the conversion table 210 for determining the target temperature of PID control and FIG. 6B is a diagram showing an example of the conversion table 220 for determining the P constant of the PID control.

As shown in FIG. 6A, in the conversion table 210, the arrival time Tx, the temperature difference Td, and the target temperature are associated with one another. In detail, as the arrival time Tx is longer and the temperature difference Td is larger, a paper is thicker and thus a higher target temperature is associated. Furthermore, as shown in FIG. 6B, in the conversion table 220, the arrival time Tx, the temperature difference Td, and the P constant are associated with one another. In detail, as the arrival time Tx is longer and the temperature difference Td is larger, a paper is thicker and thus a higher value is associated.

In the process shown in step S111, the conversion tables 210 and 220 are referred to and the control parameters of the heaters 156 and 157 are determined from the arrival time Tx and the temperature difference Td. For example, when the arrival time Tx is 4 sec and the temperature difference Td is 7° C., the target temperature and the P constant are determined to 170° C. and 5, respectively. In addition, also in the I constant and the D constant, as the arrival time Tx is longer and the temperature difference Td is larger, a higher value is determined in a similar manner.

Then, the image forming apparatus 100 proceeds to the PID control (step S112) and ends the procedure. In more detail, the controller 110 of the image forming apparatus 100 stops the on/off control of the heating roller 151 and starts the PID control by applying the control parameters determined in the process shown in step S111. In addition, since the technology itself of calculating the duty ratio by the PID control and controlling the heaters 156 and 157 is a well-known technology, a detailed description thereof will be omitted.

As described above, according to the procedure of the flowchart shown in FIG. 5, after the on/off control starts, it is detected that the temperature of the heating roller 151 has reached the lower limit value at which the temperature reduced once by the start of the heating and fixing process to the paper S turns to rise. Then, on the basis of the arrival time Tx until the temperature of the heating roller 151 reaches the lower limit value and the temperature difference Td between the temperature of the heating roller 151 at the start time point of the on/off control and the lower limit value, the type of the paper is determined and the determined type of the paper is reflected in the PID control parameters of the heaters 156 and 157. According to such a configuration, the heating and fixing process is performed by applying control parameters corresponding to the type of the paper, so that it is possible to improve the quality of an image formed on the paper S by the image forming apparatus 100.

In addition, in the flowchart shown in FIG. 5, when it is determined once that the temperature gradient is equal to or more than 0 in the process shown in step S108, it is determined that the temperature of the heating roller 151 has reached the lower limit value. However, when it is determined only once that the temperature gradient is equal to or more than 0, it may not be determined that the temperature of the heating roller 151 has reached the lower limit value, and when it is determined a plurality of times that the temperature gradient is equal to or more than 0, it may also be determined that the temperature of the heating roller 151 has reached the lower limit value.

Figure 7:
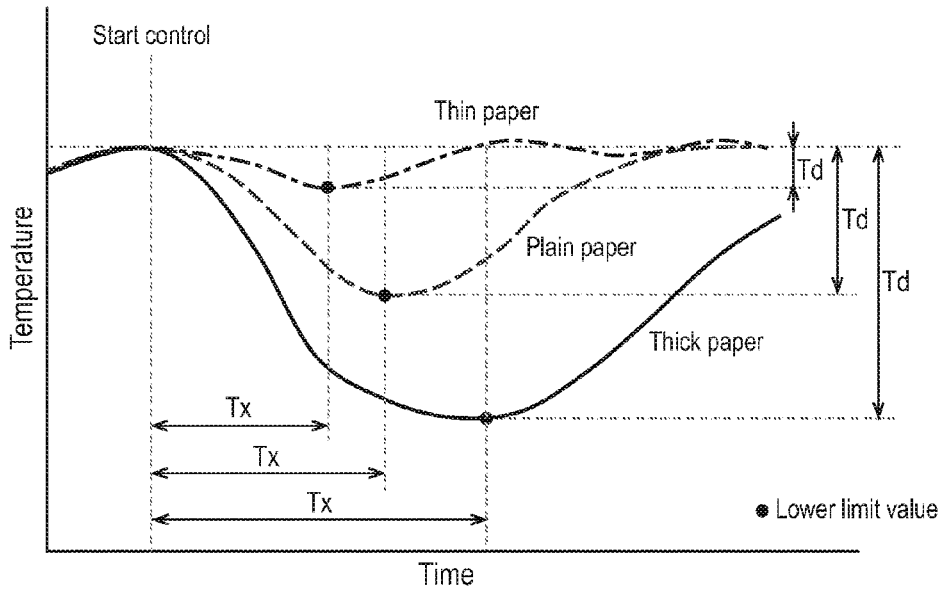
FIG. 7 is a diagram showing a relation between the type of papers and the temperature of a heating roller.

FIG. 7 is a diagram showing a relation between the type of papers and the temperature of the heating roller 151. In FIG. 7, a vertical axis denotes a temperature and a horizontal axis denotes a time. FIG. 7 shows a temperature transition of the heating roller 151 when three different types of papers have been fed. In FIG. 7, a solid line denotes a temperature transition when a thick paper has been fed, a one dot chain line denotes a temperature transition when a thin paper has been fed, and a broken line denotes a temperature transition when a plain paper has been fed.

As shown in FIG. 7, immediately after the on/off control starts, since heat applied from the heaters 156 and 157 is not sufficiently transmitted to the surface of the heating roller 151, when a paper passes through the fixing unit 150, the heat is taken away by the paper and the surface temperature of the heating roller 151 is reduced once. Thereafter, when the heat applied from the heaters 156 and 157 by the on/off control is sufficiently transmitted to the surface of the heating roller 151, the reduction of the surface temperature of the heating roller 151 is stopped and the temperature starts to rise. Herein, the arrival time Tx until the temperature reaches the lower limit value from the start time point of the on/off control becomes longer as the paper is thicker. Furthermore, the temperature difference Td between the temperature of the heating roller 151 at the start time point of the on/off control and the lower limit value becomes larger as the paper is thicker.

In the paper type determination process of the present embodiment, the temperature transition of the heating roller 151 is measured and the lower limit value (a minimum point) of the temperature of the heating roller 151 is detected as a feature point at which the difference of temperature characteristics corresponding to the type of papers is initially noticeable. Then, the type of the paper is determined from the arrival time Tx until the temperature of the heating roller 151 reaches the lower limit value and the temperature difference Td between the temperature of the heating roller 151 at the start time point of the on/off control and the lower limit value. According to such a configuration, the temperature of the heating roller 151 is measured, so that it is possible to accurately determine the type of the paper in a short time as much as possible.

Figure 8A:
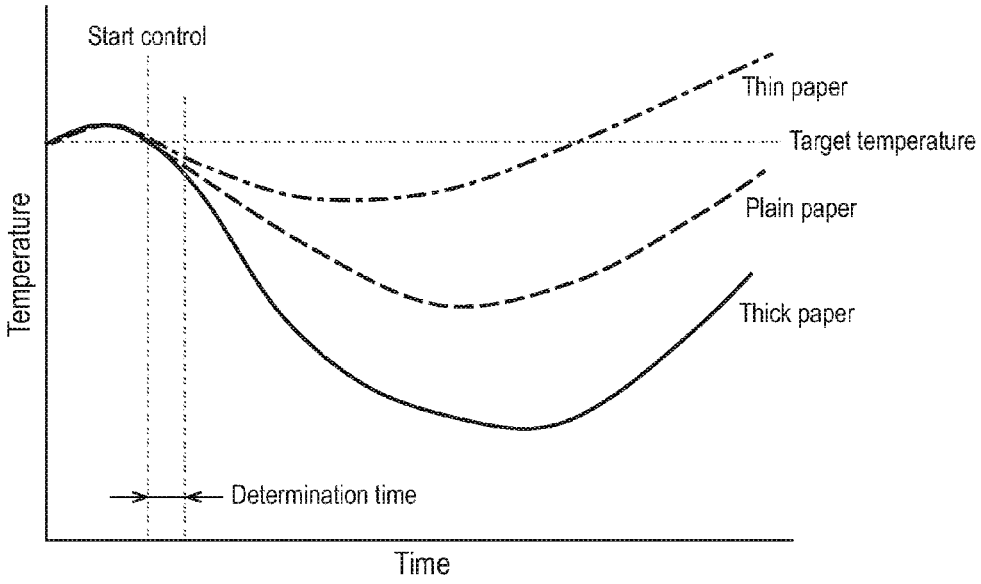
FIGS. 8A and 8B are diagrams for explaining effects of a paper type determination process.
Figure 8B:
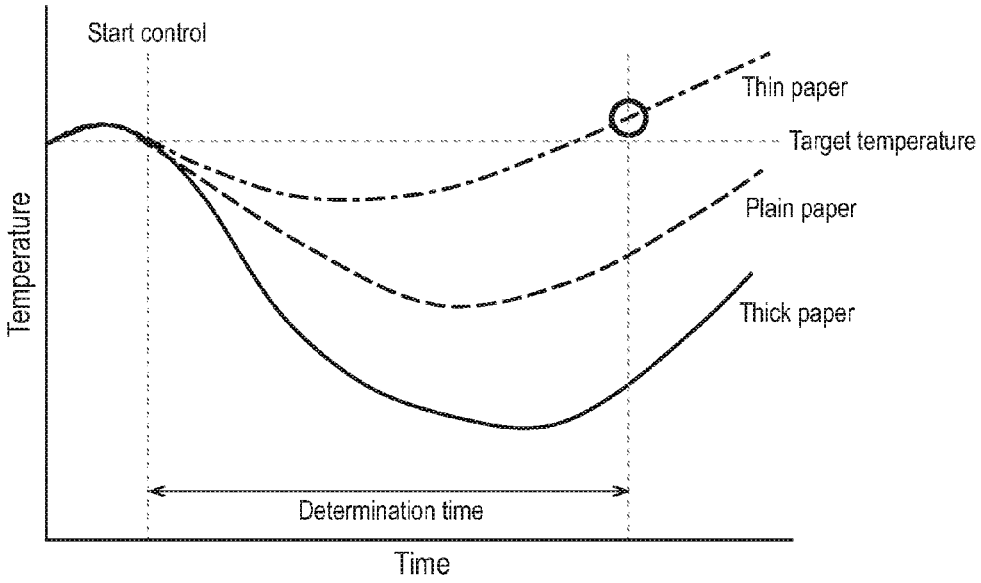

FIGS. 8A and 8B are diagrams for explaining effects of the paper type determination process. FIG. 8A is a diagram showing a temperature transition when one paper is fed and the type of the paper is determined and FIG. 8B is a diagram showing a temperature transition when a plurality of papers are fed and the type of the papers is determined.

As shown in FIG. 8A, when one paper is fed and the type of the paper is determined (that is, when a determination time is too short), since a temperature change of the heating roller corresponding to the type of the paper is small, there is a possibility that the type of the paper cannot be determined accurately. Furthermore, as shown in FIG. 8B, when a plurality of papers are fed and the type of the papers is determined, if a determination time is too long, a time for performing on/off control also becomes long and a time point for proceeding to the PID control is delayed. When the time point for proceeding to the PID control is delayed, since overshoot occurs in a thin paper, there is a possibility that image quality is degraded.

On the other hand, in the paper type determination process of the present embodiment, the lower limit value of the temperature is detected as the feature point at which the difference of the temperature characteristics corresponding to the type of papers is initially noticeable and the type of the paper is determined, so that it is possible to accurately determine the type of the paper in a short time as much as possible.

In addition, in the present embodiment, the thickness of a paper can be classified on the basis of a basis weight of the paper. In detail, when the basis weight of the paper is smaller than a first value (for example, 50 $g/m^2$), the paper type is classified into a "thin paper", and when the basis weight of the paper is equal to or more than a second value (for example, 128 $g/m^2$), the paper type is classified into a "thick paper". Furthermore, when the basis weight of the paper is equal to or more than the first value and smaller than the second value, the paper type is classified into a "plain paper".

Furthermore, the controller 110 of the image forming apparatus 100 allows the CPU to execute corresponding programs, thereby serving as a detection unit configured to detect that the temperature of the heating roller 151 has reached the lower limit value and a paper type determination unit (a determination unit) configured to determine the type of the paper.

The present invention shall not be limited to the aforementioned embodiment, and hence it can be variously modified within the scope of the appended claims.

For example, in the above-described embodiment, on the basis of both of the arrival time Tx until the temperature of the heating roller 151 reaches the lower limit value and the temperature difference Td between the temperature of the heating roller 151 at the start time point of the on/off control and the lower limit value, the type of the paper is determined. However, the type of the paper may also be determined on the basis of any one of the arrival time Tx and the temperature difference Td.

In addition, when the temperature of the heating roller 151 reaches the lower limit value, the temperature of the heating roller 151 rises and the temperature difference with the temperature of the heating roller 151 at the start time point of the on/off control is reduced. Consequently, the type of the paper is determined using a lower limit value at which the temperature difference with the temperature of the heating roller 151 at the start time point of the on/off control is maximum, so that the determination accuracy of the type of the paper is highest as compared with the case of determining the type of the paper by using a temperature difference at other time points.

Furthermore, in the above-described embodiment, by employing the start time point of the on/off control as a reference, the arrival time Tx until the temperature of the heating roller 151 reaches the lower limit value and the temperature difference Td with the lower limit value are obtained. However, a reference time point serving as a reference when obtaining the arrival time and the temperature difference is not limited to the start time point of the on/off control and can be set to an arbitrary time point after the start of the image forming operation. For example, after the start of the image forming operation, a time point at which an initial paper makes contact with the heating roller 151 may also be estimated and the estimated time point may also be set as the reference time point.

Furthermore, in the above-described embodiment, the case in which the image forming apparatus performs the copy process has been described as an example. However, the present invention, for example, can also be applied to a case in which the image forming apparatus receives print data and performs a print process.

Units and a method for performing various processes in the image forming apparatus according to the above-described embodiments can also be realized by any one of a dedicated hardware circuit and a programmed computer. The aforementioned program, for example, may also be provided by a computer readable recording medium such as a flexible disk and CD-ROM (Compact Disc Read Only Memory), or may also be provided on-line via a network such as the Internet. In this case, the program recorded in the computer readable recording medium is normally transmitted to and stored in a storage unit such as a hard disk. Furthermore, the aforementioned program may also be provided as single application software or may also be incorporated in software of an image forming apparatus as one function of the apparatus.

What is claimed is:

1. An image forming apparatus comprising:

a paper feeding tray configured to store papers;

a conveying unit configured to convey a paper stored in the paper feeding tray;

an image forming unit configured to form a toner image on the paper conveyed by the conveying unit;

a fixing member configured to heat and fix the toner image formed by the image forming unit onto the paper;

a temperature sensor configured to detect a temperature of the fixing member;

a heater configured to heat the fixing member;

a detection unit configured to detect that the temperature of the fixing member reaches a lower limit value at which the temperature once reduced by start of a heating and fixing process to the paper turns to rise, after an image forming operation starts; and a determination unit configured to determine a type of the paper based on at least one of an elapsed time from a predetermined reference time point after the image forming operation starts to a time point at which it is detected that the temperature of the fixing member reaches the lower limit value, and a temperature difference between the temperature of the fixing member at the reference time point and the lower limit value.

2. The image forming apparatus as claimed in claim 1, wherein the determination unit determines that the paper is thicker as the temperature difference is larger.

3. The image forming apparatus as claimed in claim 1, wherein the determination unit determines that the paper is thicker as the elapsed time is longer.

4. The image forming apparatus as claimed in claim 1, further comprising:

a controller configured to control an operation of the heater by reflecting the type of the paper determined by the determination unit in a control parameter of the heater.

* * * * *